US007314383B1

(12) United States Patent
Ho et al.

(10) Patent No.: US 7,314,383 B1
(45) Date of Patent: Jan. 1, 2008

(54) PLUG CONNECTOR

(75) Inventors: Hsin-Tsung Ho, Tu-Cheng (TW); Kai-Hsiang Chang, Tu-Cheng (TW); Chung-Hsin Huang, Tu-Cheng (TW); Mei-Chuan Yang, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/554,998

(22) Filed: Oct. 31, 2006

(51) Int. Cl.
*H01R 13/627* (2006.01)

(52) U.S. Cl. ..... 439/353

(58) Field of Classification Search ..... 439/353, 439/357, 610
See application file for complete search history.

(56) References Cited

U.S. PATENT DOCUMENTS 5,660,558 A * 8/1997 Osanai et al. ..... 439/353
6,394,842 B1 * 5/2002 Sakurai et al. ..... 439/607
7,175,465 B1 * 2/2007 Tsai ..... 439/352
2005/0245132 A1 * 11/2005 Huang et al. ..... 439/607
2005/0282424 A1 * 12/2005 Huang et al. ..... 439/353
2006/0228946 A1 * 10/2006 Chung ..... 439/607

* cited by examiner

*Primary Examiner*—Tulsidas C. Patel
*Assistant Examiner*—Vladimir Imas
(74) *Attorney, Agent, or Firm*—Birch, Stewart, Kolasch & Birch, LLP

(57) ABSTRACT

A plug connector includes an upper metal cover, a lower metal cover and a conductor assembly. The upper metal cover has a front cavity and a back cavity which has a top plank. The bottom of the front cavity extends backward and forms an extension portion. Two sides of the back of the top plank bend downward and form two opposite side planks. The side plank stretches forward from its front and forms a locking slice. The conductor assembly includes a plurality of conductor pins, a housing and latches. The conductor pins and the latches are held in the housing. The housing includes a front housing and a back housing. Each side of the back housing opens a preventing recess. At the junction of the back housing and the front housing, a front wall of the back housing hollows inside and defines a recessed portion.

6 Claims, 5 Drawing Sheets

PLUG CONNECTOR

BACKGROUND OF THE INVENTION

1. Field of the Invention

The present invention relates to a plug connector, and more particularly to a plug connector which works steadily even it is often used in a strong force.

2. The Related Art

As the development of electronic and communications technology, many kinds of connection methods, such as USB (Universal Serial Bus), are used in electronic products. In accordance with these communicational mediums, different kinds of connectors are invented and the stability of connectors is highly required.

A traditional USB plug connector includes an upper metal cover, a lower metal cover, a plurality of conductor pins, a housing, latches, a cable and a plastic cover. The upper metal cover buckles with the lower metal cover and the two metal covers define a space therebetween. The conductor pins and the latches are held in the housing. The front of the housing stretches out from the front of the upper metal cover. The back of the housing is placed into the space. The cable is fixed in the rear of the metal covers. The plastic cover swathes the metal covers and the cable.

However, there is no fixing device between the housing and the metal covers. When the USB plug connector is often disconnected from a receptacle connector by a strong force, the housing steps back and leads to loosing between the USB plug connector and a receptacle connector. Sometimes, the USB plug connector is easily damaged.

SUMMARY OF THE INVENTION

It is an object of the present invention to provide a plug connector with steady mechanisms inside.

To achieve the above object, the plug connector comprises an upper metal cover, a lower metal cover and a conductor assembly. The upper metal cover has a front cavity and a back cavity. The bottom of the front cavity extends backward and forms an extension portion. The back cavity has a top plank and a front plank. Two sides of the back of the top plank bend downward and form two opposite side planks. The side plank stretches forward from its front and forms a locking slice. A front portion of the lower metal cover sets up a front mouth with the front cavity stretching out of the front mouth. The back cavity and the lower metal cover buckle with each other and define a space therebetween. The conductor assembly includes a plurality of conductor pins, a housing and latches. The housing further includes a back housing and a front housing which is formed by the back housing stretching forward from its middle. The back housing has a front wall, a back wall and two sidewalls. The back of the sidewall of the back housing sets up a preventing recess. At the junction of the back housing and the front housing, the front wall of the back housing hollows inside and defines a recessed portion. When the housing is held in the upper metal cover and the lower metal cover, the front housing is located in the front cavity and the back housing is located in the space. The conductor pins are inserted in the housing. The latches are fixed in the housing too and each latch has a resilient arm. The resilient arm bends vertically and then bends horizontally and stretches forward to form a horizontal leg. The resilient arm is held by an upper cavity and the horizontal leg is held by a lower cavity of the housing. Each resilient arm has a hook at its head and the hook protrudes outside of the front cavity.

In terms of the above description, the object is realized by the locking slices correspondingly inserted into the preventing recesses and the extension portion inserted into the recessed portion when the upper metal cover and the housing are assembled.

BRIEF DESCRIPTION OF THE DRAWINGS

The invention, together with its objects and the advantages thereof may be best understood by reference to the following description taken in conjunction with the accompanying drawings, in which.

DETAILED DESCRIPTION OF THE PREFERRED EMBODIMENT

Figure 1:
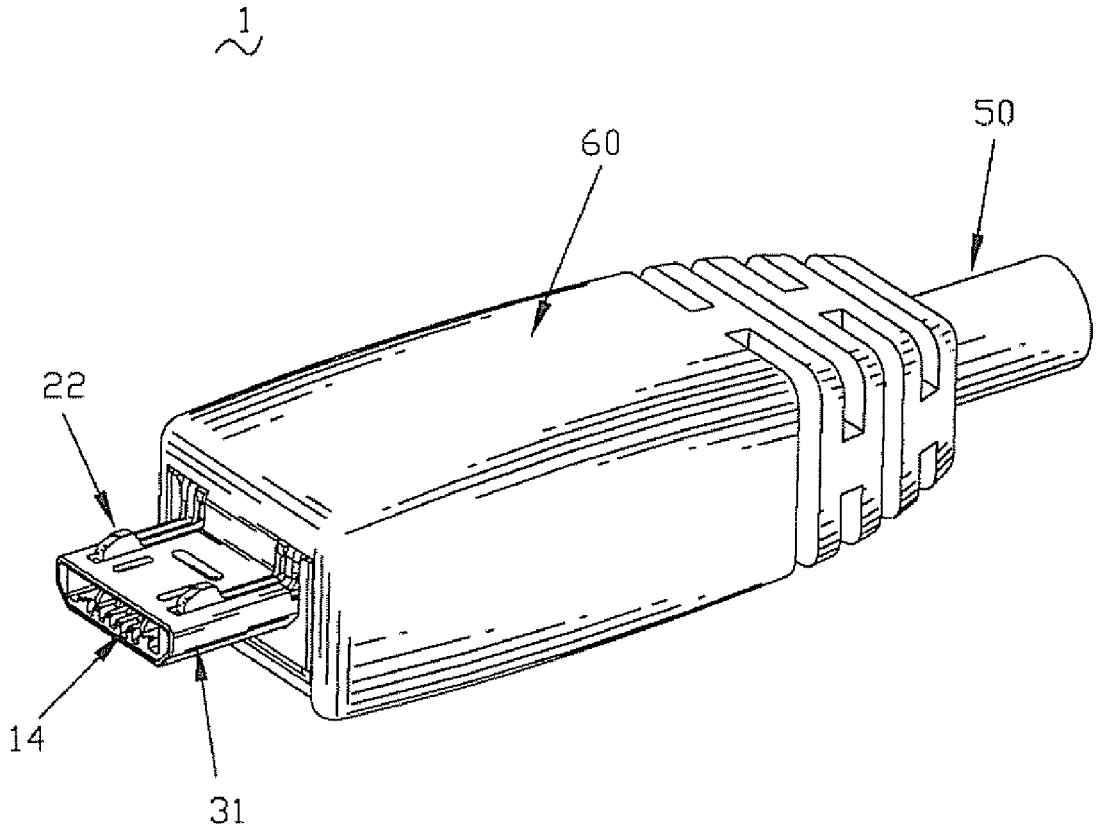
FIG. 1 is a perspective view of a plug connector in accordance with the present invention.
Figure 2:
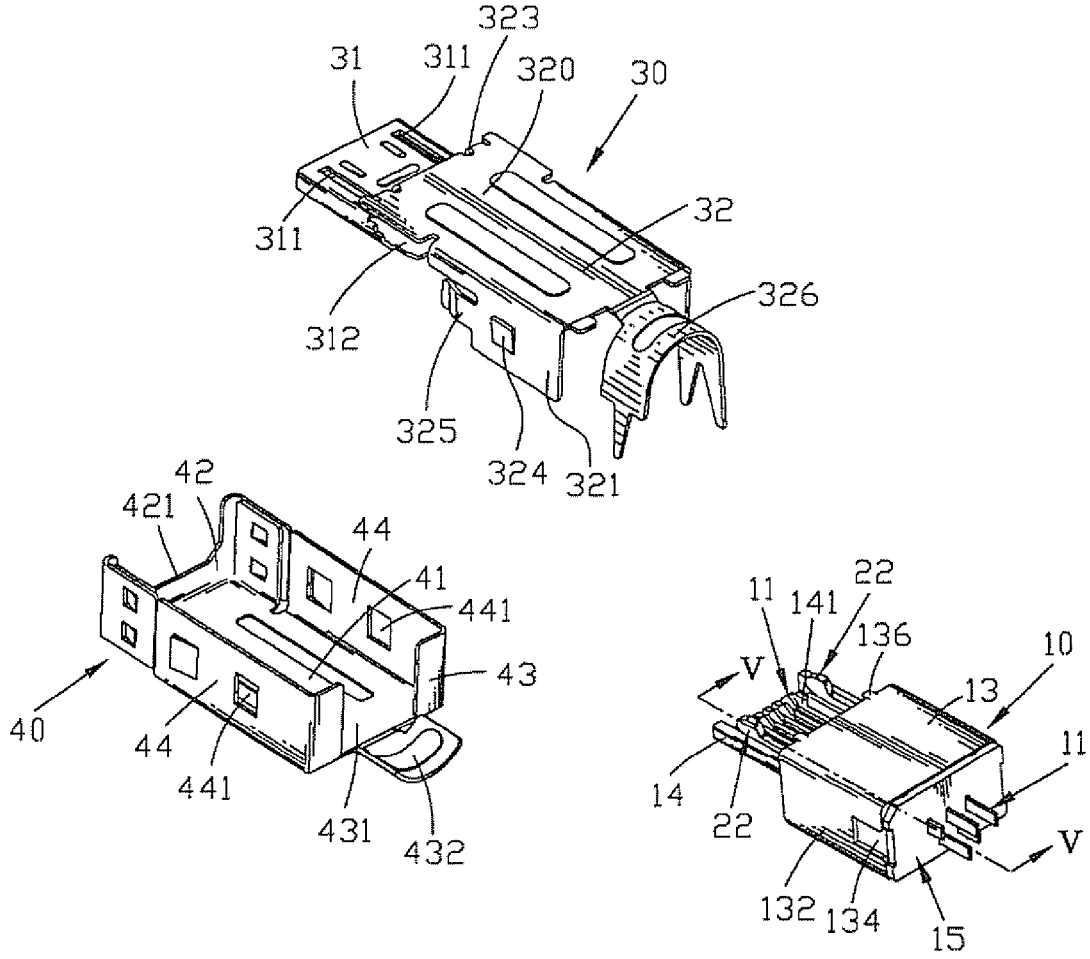
FIG. 2 is an exploded view of a conductor assembly, an upper metal cover and a lower metal cover of the plug connector of FIG. 1.

Referring to FIGS. 1 to 2, a plug connector 1 according to the present invention includes a conductor assembly 10, an upper metal cover 30, a lower metal cover 40, a cable 50 and a plastic cover 60.

Figure 3:
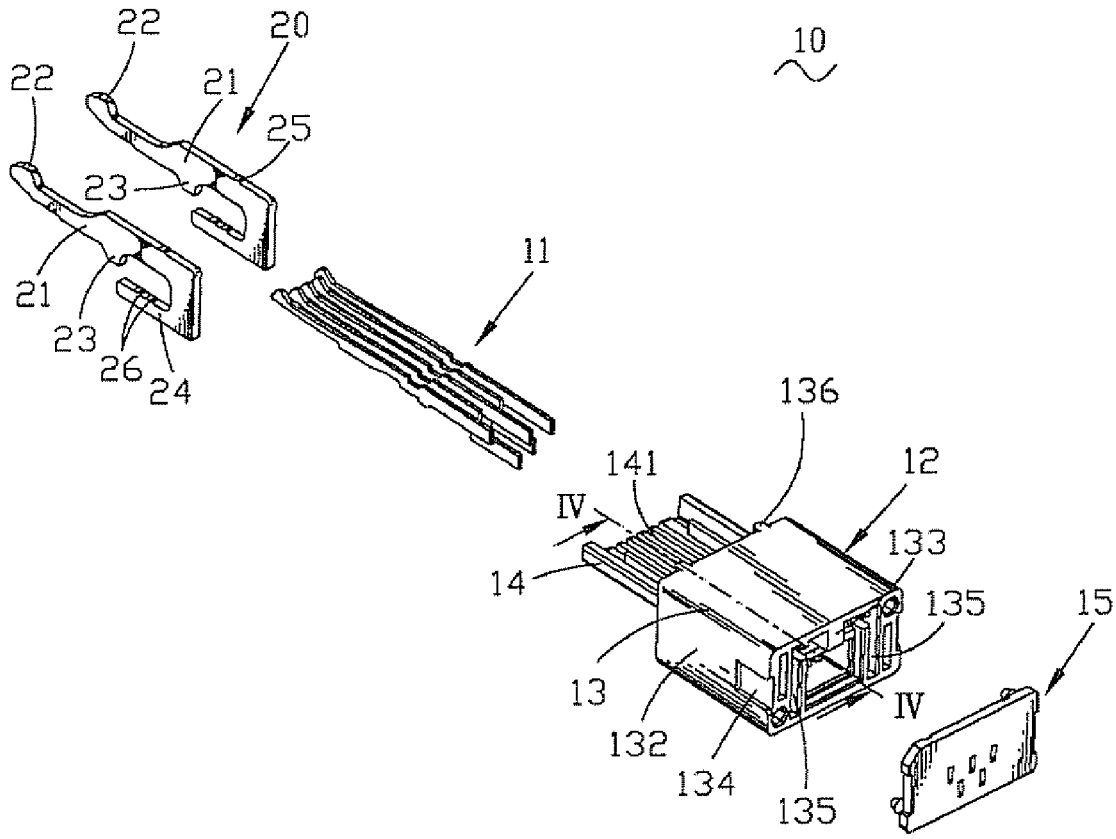
FIG. 3 is a detailed view of the conductor assembly of the plug connector.
Figure 4:
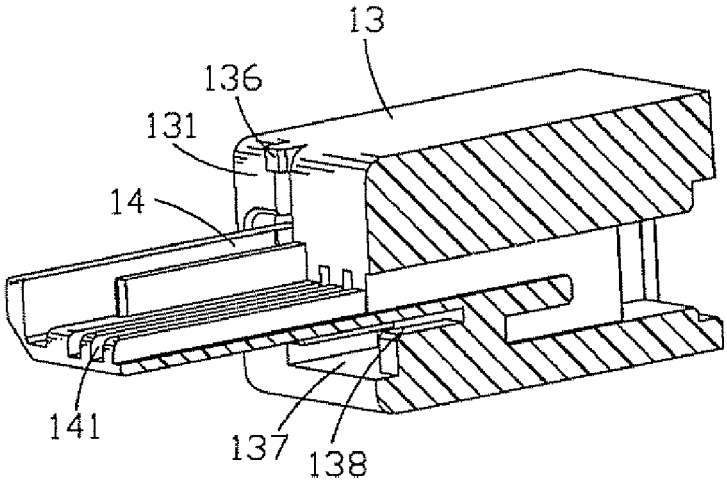
FIG. 4 is a cross-sectional view taken along line IV-IV of a housing of FIG. 3.
Figure 5:
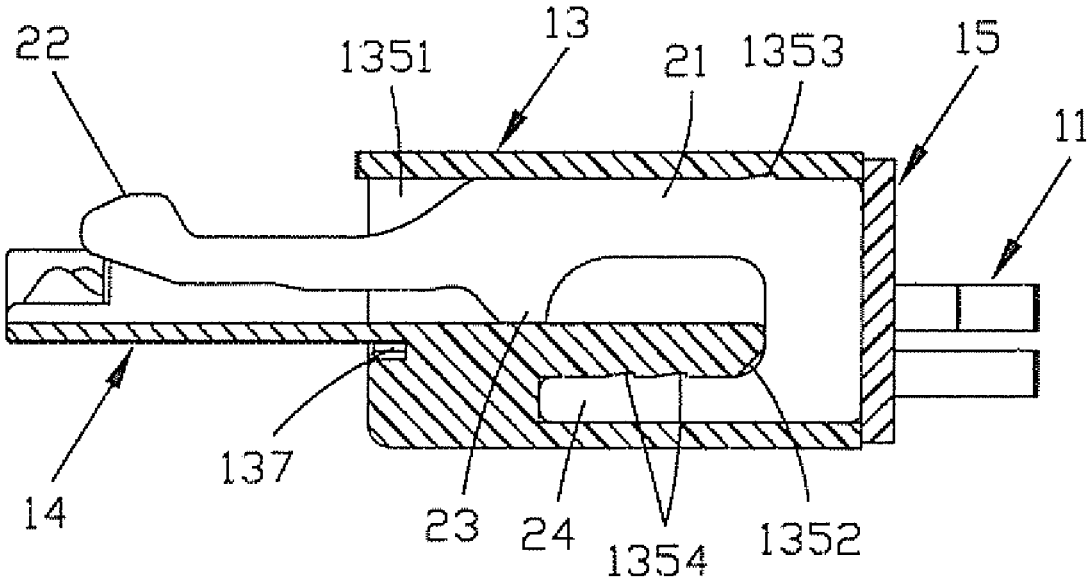
FIG. 5 is a cross-sectional view taken along line V-V of the conductor assembly of FIG. 2.

Referring to FIGS. 3-5, the conductor assembly 10 comprises a plurality of conductor pins 11, a housing 12, latches 20 and a back lid 15. The housing 12 further includes a back housing 13 and a front housing 14 which is formed by the back housing 13 stretching forward from its middle. The back housing 13 has a front wall 131, a back wall 133 and two sidewalls 132. The top of each side of the front wall 131 protrudes forward and forms a projection 136. The back of the sidewall 132 opens a preventing recess 134. In the back wall 133 there are two cavities 135 are set up. Each cavity 135 includes an upper cavity 1351 and a lower cavity 1352. The upper cavity 1351 passes through the back housing 13 and the front housing 14. In the top surface of the upper cavity 1351, an upper fixing hole 1353 is opened. The lower cavity 1352 is connected with the rear of the upper cavity 1351 and stretches forward to the middle of the back housing 13. At the top surface of the lower cavity 1352 it either sets up two lower fixing holes 1354. The top surface of the front housing 14 opens several receiving slots 141. These receiving slots 141 pass through the back housing 13 and the side receiving slots 141 are connected with the cavities 135. At the junction of the back housing 13 and the front housing 14, the front wall 131 of the back housing 13 hollows inside and forms a recessed portion 137. At the bottom surface of the recessed portion 137, it protrudes upward and forms a supporting section 138.

There are two same latches 20 and each latch 20 has a horizontal resilient arm 21. The resilient arm 21 hollows and stretches forward and then forms a hook 22 at the head. The resilient arm 21 protrudes downward and forms a locating block 23 at the bottom surface of the middle of the resilient arm 21. The rear of the resilient arm 21 bends downward and then bends horizontally and stretches forward to the below of the locating block 23 and then forms a horizontal leg 24.

The resilient arm 21 protrudes upward from its top surface and forms an upper fixing block 25. The horizontal leg 24 protrudes upward from its top surface and defines two lower fixing blocks 26.

When the conductor assembly 10 is assembled, the conductor pins 11 are inserted in the back housing 13 and located in the receiving slots 141 of the front housing 14. The latches 20 are held in the housing 12. The resilient arm 21 is located into the upper cavity 1351 and the horizontal leg 24 is located into the lower cavity 1352 correspondingly. The upper fixing block 25 and the lower fixing blocks 26 are also correspondingly fixed into the upper fixing hole 1353 and the lower fixing holes 1354. The locating block 23 is placed on the bottom surface of the upper cavity 1351. The back lid 15 buckles with the back wall 133 of the back housing 13 with the conductor pins 11 passing through the back lid 15.

Figure 6:
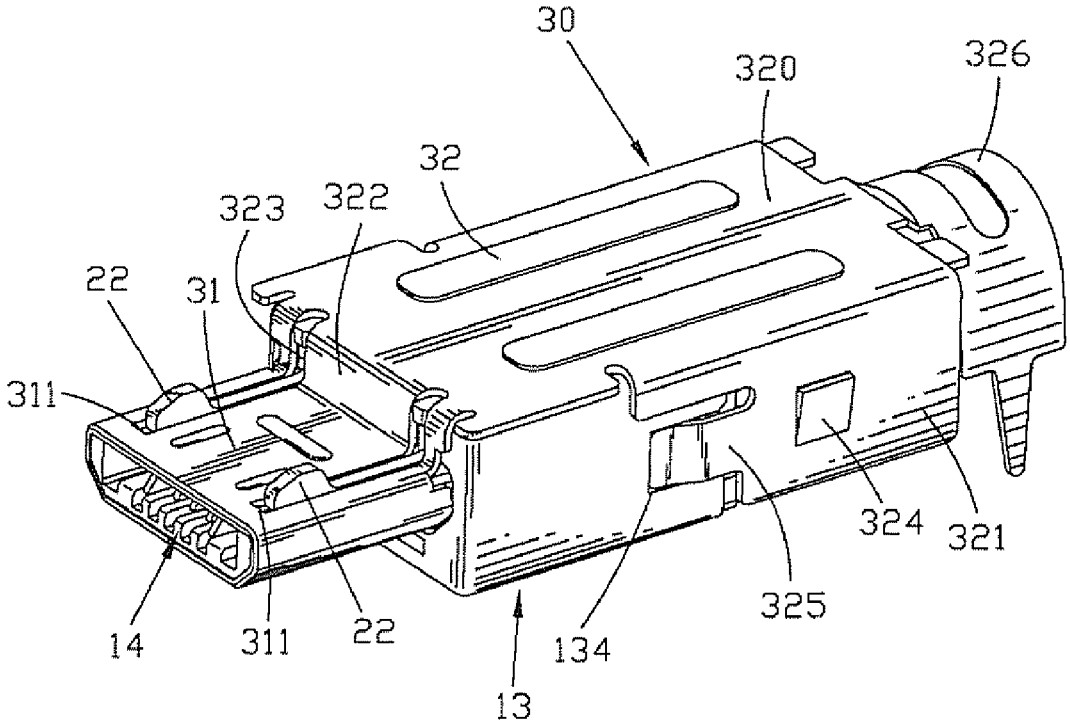
FIG. 6 is an assembled view of the conductor assembly and the upper metal cover of the plug connector.

Please refer to FIGS. 2 and 6, the upper metal cover 30 has a back cavity 32. The front of the back cavity 32 bends downward and then stretches forward and forms a front cavity 31. On the top surface of the front cavity 31 there sets up two holding openings 311. The bottom of the front cavity 31 stretches backward and forms an extension portion 312. The back cavity 32 has a top plank 320 and a front plank 322. Each side of the front plank 322 opens an opening slot 323 which is on line with the holding opening 311. Two sides of the back cavity 32 bend downward from the back of the top plank 320 and form two opposite side planks 321. Each side plank 321 protrudes outside and forms a card contact portion 324. The front of the side plant 321 stretches forward and forms a locking slice 325. The rear of the top plank 320 of the back cavity 32 stretches backward and forms a retention-section 326 which is bent downward.

The lower metal cover 40 includes a basic portion 41, a front portion 42, a back portion 43 and two side portions 44. The front portion 42 sets up a front mouth 421 at its middle and the back portion 43 either sets up a back mouth 431. The bottom of the back mouth 431 stretches backward and defines an immovable slice 432. Each side portion 44 opens an aperture 441 in accordance with the card contact portion 324 of the upper metal cover 30.

Referring to FIG. 1, FIG. 2 and FIG. 6, when the conductor assembly 10 and the upper metal covers 30 are assembled, the front housing 14 is located in the front cavity 31. The projection 136 of the front wall 131 of the back housing 13 is inserted in the top of the opening slot 323 to prevent the mucilage overflowing. The front of the resilient arms 21 and the hooks 22 are located into the holding openings 311 with the hooks 22 protruding outside of the front cavity 31. The extension portion 312 of the front cavity 31 is inserted into the recessed portion 137 and is placed between the supporting section 138 and the top surface of the recessed portion 137. The front of the top plank 320 of the back cavity 32 covers the top surface of the back housing 13 and the back lid 15. The locking slices 325 are inserted into the preventing recesses 134 to prevent the conductor assembly 10 removing backward. Then, the assembled combination of the conductor assembly 10 and the upper metal cover 30 is located into the lower metal cover 40. The back cavity 32 of the upper metal cover 30 and the lower metal cover 40 define a space therebetween. The back housing 13 and the back lid 15 are held into the space. The front cavity 31 of the upper metal cover 30 stretches out of the front mouth 421 of the lower metal cover 40. The card contact portions 324 buckle with the apertures 441 of the lower metal cover 40. The cable 50 is placed in the back of the metal covers and fastened by the retention-section 326 and the immovable slice 432. The plastic cover 60 swathes the metal covers and the cable 50.

Although preferred embodiment of the present invention have been described in detail hereinabove, it should be clearly understand that many variations and/or modifications of the basic inventive concepts herein taught which may appear to those skilled in the present art will fall within the spirit and scope of the present invention, as defined in the appended claims.

What is claimed is:

1. A plug connector, comprising:

an upper metal cover and a lower metal cover, the upper metal cover having a front cavity and a back cavity, the back cavity having a top plank and a front plank, two sides of the back of the top plank bending downward and forming two opposite side planks, the back cavity and the lower metal cover defining a space, a front portion of the lower metal cover setting up a front mouth, the front cavity stretching out of the front mouth; and a conductor assembly, including a plurality of conductor pins, a housing and latches, the housing further including a back housing and a front housing which is formed by the back housing stretching forward from its middle, the back housing which is held into the space having a front wall, a back wall and two sidewalls, the front housing located in the front cavity, the conductor pins inserted in the housing, the latches fixed in the housing too, each latch having a resilient arm and forming a hook at the head of the resilient arm, the resilient arm bending vertically and then bending horizontally and stretching forward to form a horizontal leg, the resilient arm held by an upper cavity and the horizontal leg held by a lower cavity of the housing, the hooks protruding outside of the front cavity;

wherein the side plank of the back cavity of the upper metal cover stretching forward from its front and forming a locking slice, correspondingly, the sidewall of the back housing opening a preventing recess with the locking slice inserted into the preventing recess, the bottom of the front cavity extending backward and forming an extension portion, and at the junction of the back housing and the front housing, the front wall of the back housing hollowing inside and defining a recessed portion, the extension portion inserted into the recessed portion; and wherein the bottom surface of the recessed portion protrudes upward and forms a supporting section, when the front housing is located into the front cavity, the extension portion is placed between the supporting section and the top surface of the recessed portion.

2. The plug connector as claimed in claim 1, wherein the preventing recess is opened at the rear of each sidewall of the back housing.

3. The plug connector as claimed in claim 1, wherein the top of each side of the front wall of the back housing protrudes forward and forms a projection, the side of the front plank opens an opening slot, when the conductor assembly and the upper metal cover are assembled, the projection is inserted in the top of the opening slot.

4. The plug connector as claimed in claim 1, wherein the latch has a horizontal resilient arm, at the middle of the bottom surface of the resilient arm, the resilient arm protrudes downward and defines a locating block, the rear of the resilient arm bends vertically and then bends horizontally and stretches forward to form a horizontal leg.

5. The plug connector as claimed in claim 4, wherein the upper cavity and the lower cavity are opened at the back wall of the back housing for holding the resilient arm and the horizontal leg of the latch correspondingly, the upper cavity passes through the back housing and the front housing, the lower cavity connects with the rear of the upper cavity and stretches forward to the middle of the upper cavity, the locating block of the latch is placed on the top surface of the upper cavity.

6. The plug connector as claimed in claim 1, wherein the upper cavity and the lower cavity are opened at the back wall of the back housing for holding the resilient arm and the horizontal leg of the latch correspondingly, the upper cavity passes through the back housing and the front housing, the lower cavity connects with the rear of the upper cavity and stretches forward to the middle of the upper cavity, the locating block of the latch is placed on the top surface of the upper cavity.

* * * * *